United States Patent [19]

Hamada et al.

[11] 4,425,199

[45] Jan. 10, 1984

[54] PROCESS FOR THE PREPARATION OF (ω-FLUOROSULFONYL)-HALOALIPHATIC CARBOXYLIC ACID FLUORIDES

[75] Inventors: Masato Hamada; Jukichi Ohmura, both of Yokohama; Fumio Muranaka, Kawasaki, all of Japan

[73] Assignee: Asahi Kasei Kogyo Kabushiki Kaisha, Osaka, Japan

[21] Appl. No.: 360,676

[22] Filed: Mar. 22, 1982

[30] Foreign Application Priority Data

Apr. 2, 1981 [JP] Japan ..... 56-48383

[51] Int. Cl.[3] ..... B01K 3/00; C07C 143/70

[52] U.S. Cl. ..... 204/59 F

[58] Field of Search ..... 204/59 F

[56] References Cited

U.S. PATENT DOCUMENTS

| | | | |
|---|---|---|---|
| 2,519,983 | 8/1950 | Simons | 204/59 F |
| 2,593,737 | 4/1952 | Diesslin et al. | 260/514 |
| 2,732,398 | 1/1956 | Brice | 204/59 F |
| 3,028,321 | 4/1962 | Danielson et al. | 204/59 F |
| 3,423,299 | 1/1969 | Loree | 204/59 F |
| 3,623,963 | 11/1971 | Voss | 204/59 F |
| 3,919,057 | 11/1975 | Plattner | 204/59 F |

*Primary Examiner*—John F. Niebling

*Attorney, Agent, or Firm*—Birch, Stewart, Kolasch & Birch

[57] ABSTRACT

A novel process is disclosed for preparing (ω-fluorosulfonyl)haloaliphatic carboxylic acid fluorides by electrolytic fluorination, simply and efficiently.

6 Claims, No Drawings

PROCESS FOR THE PREPARATION OF (ω-FLUOROSULFONYL)-HALOALIPHATIC CARBOXYLIC ACID FLUORIDES

This invention relates to a process for the preparation of (ω-fluorosulfonyl)haloaliphatic carboxylic acid fluorides, and more particularly to a process for the preparation of the same, which enables the desired products to be obtained simply and efficiently.

Perfluoro compounds and fluoro compounds having a carboxylic acid group or a sulfonic acid group are widely used as starting materials for the manufacture of surface active agents, lubricants, water repellents and oil repellents, and it is known that these compounds are prepared by electrolytic fluorination.

However, the preparation of perfluoro compounds and fluoro compounds having both a carboxylic acid group or a group derived therefrom and a sulfonic acid group or a group derived therefrom has seldom been reported. Mentioned in the specification of U.S. Pat. No. 2,852,554 is a process for the preparation of fluorosulfonyldifluoroacetyl fluoride ($FSO_2CF_2COF$), in which the desired compound is prepared by utilizing the addition reaction with tetrafluoroethylene. Further, the processes for the preparation of $FSO_2(CF_2)_nCOF$ in which n is at least 2 are disclosed in Japanese Patent Application Laid-Open Specifications No. 160008/80 and No. 160030/80, but these processes include a great number of steps and require complicated reactions.

The present inventors made extensive and intensive researches with a view to developing a new process for preparing the foregoing compounds at high efficiency by a small number of steps, and as a result, they have succeeded in developing a process for preparing (ω-fluorosulfonyl)haloaliphatic carboxylic acid fluorides conveniently with ease.

More specifically, in accordance with the present invention, there is provided a process for the preparation of an (ω-fluorosulfonyl)haloaliphatic carboxylic acid fluoride which comprises subjecting to electrolysis an electrolyte comprising at least one compound selected from the group consisting of compounds represented by the following general formulae:

$$\underbrace{OCH_2(CX_1X'_1CX_2X'_2 \ldots CX_nX'_n)SO_2}, \quad (1)$$

$$YS(=O)_2(CX_1X'_1CX_2X'_2 \ldots CX_nX'_n)COY', \quad (2)$$

$$Y''S(=O)_2(CX_1X'_1CX_2X'_2 \ldots CX_nX'_n)CH_2OH \quad (3)$$

and $$[YS(=O)_2(CX_1CX'_1CX_2X'_2 \ldots CX_nX'_n)CO]_2O \quad (4)$$

wherein n is an integer of from 1 to 4, $X_1$ through $X_n$ and $X'_1$ through $X'_n$ each independently stand for H, Cl or F, Y stands for an alkyl group having 1 to 8 carbon atoms, OH, CL, F or OR in which R stands for an alkyl group having 1 to 8 carbon atoms, Y' stands for Cl, F, OH or OR' in which R' stands for an alkyl group having 1 to 8 carbon atoms, and Y' stands for Y or OM in which M stands for an alkali metal, and liquid hydrogen fluoride in an electrolytic cell to effect electrolytic fluorination of said at least one compound, thereby to obtain an (ω-fluorosulfonyl)haloaliphatic carboxylic acid fluoride represented by the following general formula:

$$FSO_2(CZ_1Z'_1CZ_2Z'_2 \ldots CZ_nZ')COF$$

wherein $Z'_1$ through $Z'_n$ and $Z'_1$ and $Z'_n$ each independently stand for F or Cl, and n is an integer of from 1 to 4. From the viewpoint of the reactivity, especially of the yield, it is preferred that a compound of the formula (1), a compound of the formula (2) in which Y is Cl or F and Y' is Cl or F, a compound of the formula (4) in which Y is Cl or F or a compound of the formula (3) in which Y'' stands for Cl, F, OH or ONa be used as the starting compound. From the viewpoint of availability, it is preferred that a cyclic sultone of the formula (1) in which X and X' each stand for H, a compound of the formula (2) in which Y stands for Cl or OH and Y' stands for Cl or OH or a compound of the formula (3) in which Y'' stands for OH or ONa be used as the starting compound. If both the yield and the availability are taken into account, a compound of the formula (1) in which X and X' each stand for H and a compound of the formula (3) in which Y'' stands for OH or ONa are especially preferred.

As preferred examples of the starting compound, there can be mentioned 1,2-ethanesultone, 1,3-propanesultone, 1,4-butanesultone, 1,5-pentanesultone, 2-hydroxyethanesulfonic acid, sodium 2-hydroxyethanesulfonate, 3-hydroxypropanesulfonic acid, sodium 3-hydroxypropanesulfonate, 4-hydroxybutanesulfonic acid, sodium 4-hydroxybutanesulfonate, 5-hydroxypentanesulfonic acid, sodium 5-hydroxypentanesulfonate, 2-chlorosulfonylacetyl chloride, 3-chlorosulfonylpropionic acid chloride, 4-chlorosulfonylbutyric acid chloride, 5-chlorosulfonylpentanoic acid chloride, 2-sulfoacetic acid, 3-sulfopropionic acid, 4-sulfobutyric acid and 5-sulfopentanoic acid.

In practicing the process of the present invention, the starting compound is added into liquid hydrogen fluoride and preferably dissolved therein, and the starting compound is electrolytically fluorinated.

The electrolytic fluorination can be carried out at a starting compound concentration in the electrolyte of 1 to 90% by weight. However, too high a concentration of the starting compound results in an increase of electrolytic voltage, and decomposition reactions of the unreacted starting compound, intermediate compound and desired compound are readily caused at a high starting compound concentration. On the other hand, too low a concentration of the starting compound results not only in a decrease of current efficiency but also in a disadvantageous increase of the volume of electrolyte. Therefore, it is advantageous that the starting compound concentration be 3 to 70% by weight. A current density of 0.01 to 10 A/dm$^2$ may ordinarily be adopted. However, if the current density is high, the electrolyte voltage is increased and side reactions are readily caused. Accordingly, it is advantageous that the electrolytic fluorination be carried out at a current density of 0.1 to 5 A/dm$^2$. The electrolysis temperature is −20° to 80° C. and preferably −10° to 50° C. If the fluorination is continued after the formation of the intended product, the intended product once formed is further fluorinated to form various decomposition products via complicated routes. For this reason, accumulation of the formed intended product in an electrolytic cell is not preferred. Accordingly, it is advantageous that the electrolysis temperature be relatively high and the formed intended product be successively withdrawn from the electrolytic cell. At too low a temperature, the electrolytic voltage is apt to increase. At too high a temperature, not only side reactions are readily caused but also hydrogen fluoride escapes, and, in addition in the case where a compound having a relatively low boiling point is electrolytically fluorinated, the starting compound is likely to escape from the electrolytic cell before the reaction is completed. Ordinarily, the electrolysis is carried out under atmospheric pressure, but an elevated pressure may be adopted according to need. When the electrolysis is carried out under an elevated pressure, it is advantageous that the electrolysis be conducted under a pressure lower than 760 mmHg-gauge.

The electrolysis time may, in general, be such that an electric current is caused to flow in a quantity of 1 to 200% based on the electricity quantity which is theoretically required for completion of the reaction (hereinafter referred to as "theoretical electricity quantity"). On one hand, according to the present invention, the electrolysis may be conducted until the intended fluorination reaction is completed. The electrolysis time required for completion of the reaction depends on the current density and the amount of the starting compound to be fluorinated. It is ordinarily advantageous that the electrolysis time be such that an electric current is caused to flow in a quantity of 80 to 200% of the theoretical electricity quantity. On the other hand, in the present invention, it is not necessarily required to complete the reaction. If an electric current is caused to flow in a quantity necessary for completion of the reaction, formation of decomposition products becomes conspicuous, resulting in reduction of the current efficiency. When the electrolysis is conducted at an electricity quantity of 1 to 80% based on the theoretical electricity quantity, the intended product is caused to be co-present with partially fluorinated intermediates, resulting in high current efficiency. Especially when the electrolysis is conducted at an electricity quantity of 10 to 50% based on the theoretical electricity quantity, the current efficiency exhibits a maximum value. In this way, according to the present invention, the electrolytic fluorination can be effected while exhibiting a high current efficiency. As mentioned above, when the electrolysis is effected while keeping the electrolyte to have a composition obtained at the time of current-flowing at an electricity quantity of 10 to 50% based on the theoretical electricity quantity, a high current efficiency can be maintained during the whole course of the electrolysis.

The foregoing reaction conditions vary according to the kind of the starting compound to be fluorinated, and preferred conditions may be optionally selected, taking into consideration such factors as the yield of the intended product, current efficiency and power consumption.

If the content in the electrolytic cell is stirred during the electrolysis, the yield of the intended compound can be increased while reducing the amounts of by-products. For this purpose, there may be adopted a method in which mechanical forcible stirring is performed, a method in which stirring is carried out while introducing an inert gas such as nitrogen gas and/or a method in which the electrolyte is circulated. Furthermore, the yield of the intended compound can be increased and formation of an oxidized fluorine compound which is explosive can be controlled if water is removed from the charge in the electrolytic cell. In order to remove water, it is preferred that hydrofluoric acid to be used for the reaction be preliminarily electrolyzed or the starting compound to be fluorinated be sufficiently dried.

In the present invention, an additive may be added so as to improve the selectivity to the intended compound. For example, an unsaturated cyclic sulfone such as sulfolene or a derivative thereof (reference may be made to British Patent specification No. 1,413,011); a metal fluoride such as NaF, KF, LiF, AgF, $CaF_2$ or $ALF_3$; ammonia; an organic acid such as acetic acid or propionic acid; an alcohol such as ethanol; diethyl ether; or pyridine may be used as the additive. Furthermore, a conductive agent may be added so as to reduce the electrolytic voltage. Sodium fluoride or other conductive agent customarily used for electrolytic fluorination may be used in the present invention.

The intended (ω-fluorosulfonyl)haloaliphatic carboxylic acid fluoride sometimes escapes from the electrolytic cell in such a form as is entrained by an inert gas when the inert gas is introduced for stirring or as entrained by a gas mixture formed by the electrolysis. Since the intended compound is apt to form an azeotropic mixture with hydrofluoric acid, lowering of the boiling point is readily caused. Therefore, a compound having a relatively small carbon number tends to be easily discharged from the electrolytic cell. In order to prevent excessive fluorination of the intended product, however, it is preferred to positively withdraw the intended product. When the intended product is entrained by the gas or gas mixture, there may be adopted a method in which the resulting gas mixture is passed through a layer of pellets of sodium fluoride to remove hydrofluoric acid and the intended compound is collected by a trap. In case the intended product is left in the electrolytic cell, the intended product is not dissolved in liquid hydrogen fluoride but is present in a separate layer. After the electrolysis, this layer of the intended compound may be withdrawn, purified and used.

In the present invention, an ordinary electrolytic fluorination cell provided with anodes and cathodes each made of nickel or a nickel alloy may be used as the electrolytic cell.

According to the present invention, (ω-fluorosulfonyl)haloaliphatic carboxylic acid fluorides can be advantageously obtained with ease. These compounds are very valuable as starting materials for the manufacture of oil repellents, water repellents, surface active agents, ion exchange membranes, resins and the like.

The present invention will now be described in detail with reference to the following Examples that by no means limit the scope of the present invention.

EXAMPLE 1

In an electrolytic cell made of a Monel metal, seven anodes and eight cathodes, each being formed of a nickel plate, were alternately arranged so that the distance between every two adjacent electrodes was 2 mm and the effective currentflowing area was 7.2 $dm^2$.

The electrolytic cell was charged with 500 ml of anhydrous hydrofluoric acid, and minute amounts of impurities were removed by preliminary electrolysis. Then, a solution of 36.6 g (0.3 mol) of 1,3-propanesultone in an equipment by weight of anhydrous hydrofluoric acid which had previously been subjected to preliminary electrolysis (in all the following Examples and Reference Example, a preliminary electrolysis-treated anhydrous hydrofluoric acid was similarly used) was introduced into the electrolytic cell. The electrolysis was carried out under conditions of an anode current density of 0.5 A/dm$^2$, an electrolyte temperature of 9° to 10° C., an electrolytic voltage of 6.9 V and a current quantity of 116.3 A-hr. The electrolytic voltage was finally increased to 7.8 V.

The gas mixture formed by the electrolysis was passed through a sodium fluoride pipe to remove entrained hydrogen fluoride and was then collected in a trap cooled to −78° C. by dry ice-acetone. When the collected liquid was subjected to fractional distillation, 42.3 g of perfluoro(3-fluorosulfonyl)propionic acid fluoride having a boiling point of 52° C. was obtained as the desired compound (yield: 61.3%). The current efficiency was about 50%.

The structure was determined by the infrared absorption spectrum, elementary analysis and nuclear magnetic resonance spectrum.

In the infrared absorption spectrum, there were observed an absorption of $\mu max = 5.3\mu$ due to the group

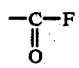

and an absorption of $\mu max = 6.8\mu$ due to the group

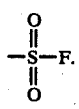

Elementary analysis values (as $C_3F_6O_3S$) were as follows.

Calculated: C=15.66%, F=49.54%, S=13.93%
Found: C=15.48%, F=49.69%, S=13.89%

EXAMPLE 2

The electrolytic cell as described in Example 1 was charged with 500 ml of anhydrous hydrofluoric acid, and minute amounts of impurities were removed by preliminary electrolysis. Then, a solution of 27.2 g (0.2 mol) of 1,4-butanesultone in an equipment by weight of anhydrous hydrofluoric acid was introduced into the electrolytic cell. The electrolysis was carried out at an anode current density of 1.0 A/dm$^2$ and an electrolyte temperature of 15° to 20° C. The initial electrolytic voltage of 5.8 V was finally increased to 7.0 V. The current quantity was 115 A-hr.

The gas mixture formed by the electrolysis was passed through a sodium fluoride pipe to remove entrained hydrogen fluoride and was then collected in a trap cooled to −78° C. by dry ice-acetone. After completion of the electrolysis, a cock disposed on the lower end of the electrolytic cell was opened to obtain 7.5 g of a colorless liquid. A small amount of a 4 Å molecular sieve (a sieve having a sieve size of 4 Å and manufactured and sold by Linde Co., U.S.A.) was added to the liquid to remove residual hydrogen fluoride, and the residue was combined with the liquid collected in the trap. The combined liquid was subjected to fractional distillation to obtain 25.2 g of perfluoro-(4-fluorosulfonyl)butyric acid fluoride having a boiling point of about 75° C. The yield was 45%.

EXAMPLE 3

In the same manner as described in Example 1, methyl 3-methylsulfonyltetrafluoropropionate, isethionic acid, 3-ethylsulfonyltetrafluoropropionic acid chloride, 3-methylsulfonyltetrafluoropropionic acid anhydride and chlorosulfonylpropionic acid chloride were electrolytically fluorinated. The obtained results are shown in Table 1.

The obtained amount and yiled of each of the intended compounds were determined by gas chromatography of the collected product.

TABLE 1

| Run No. | 1 | 2 | 3 | 4 | 5 |
|---|---|---|---|---|---|
| Starting Compound, (g) | $CH_3SO_2CF_2CF_2CO_2CH_3$, 28.3 | $HO_3SCH_2CH_2OH$, 25.2 | $C_2H_5SO_2CF_2CF_2COCl$, 25.7 | $(CH_3SO_2CF_2CF_2CO)_2O$, 21.5 | $ClO_2SCH_2CH_2COCl$, 38.2 |
| Temperature (°C.) | 5–6 | −5–0 | 10 | 10 | 10 |
| Current Density (A/dm$^2$) | 2.08 | 2.08 | 2.08 | 1.0 | 0.5 |
| Voltage (V) | 6.4 | 6.2 | 6.5 | 6.3 | 6.2 |
| Power Consumption (A-hr) | 57.5 | 106.0 | 35.4 | 8.7 | 90.0 |
| Ratio (%) of Power Consumption to Theoretical Value | 75 | 110 | 110 | 110 | 140 |
| Intended Product | $FO_2SCF_2CF_2COF$ | $FO_2SCF_2COF$ | $FO_2SCF_2CF_2COF$ | $FO_2SCF_2CF_2COF$ | $FO_2SCF_2CF_2COF$ |
| Amount Obtained (g) | 4.8 | 5.5 | 5.4 | 1.3 | 20.7 |
| Yield | 17.6 | 15.4 | 23.5 | 11.0 | 65.0 |

TABLE 1-continued

| Run No. | 1 | 2 | 3 | 4 | 5 |
|---|---|---|---|---|---|
| (%) | | | | | |

EXAMPLE 4

In the electrolytic cell as described in Example 1 was charged 500 ml of anhydrous hydrofluoric acid, and preliminary electrolysis was conducted to remove minute amounts of impurities. A solution of 48.6 g (0.3 mol) of sodium 3-hydroxy-1-propanesulfonate in an equiamount by weight of anhydrous hydrofluoric acid was then added into the electrolytic cell. The electrolysis was carried out at an anode current density of 0.05 A/dm$^2$, an electrolyte temperature of 14° to 15° C. and an electrolytic voltage of 5.1 V. The current quantity was 153.0 A-hr, and the electrolytic voltage was increased to 6.7 V.

The gas mixture formed by the electrolysis was passed through a sodium fluoride pipe to remove entrained hydrogen fluoride and was then collected in a trap cooled to −78° C. by dry ice-acetone. The collected liquid was subjected to fractional distillation to obtain 32.7 g of perfluoro(3-fluorosulfonyl)propionic acid fluoride. The yield was 47.5%.

EXAMPLE 5

The electrolytic cell as described in Example 1 was charged with 500 ml of anhydrous hydrofluoric acid, followed by preliminary electrolysis to remove minute amounts of impurities. 36.6 g (0.3 mol) of 1,3-propanesultone and 7.3 g (0.06 mol) of sulfolene were then charged, and the electrolysis was carried out at an anode current density of 2.08 A/dm$^2$, an electrolyte temperature of 9° to 10° C. and an electrolytic voltage of 6.8 V. The current quantity was 140 A-hr.

The gas mixture by the electrolysis was passed through a sodium fluoride pipe to remove entrained hydrogen fluoride and was then collected in a trap cooled to −78° C. by dry ice-acetone. The collected liquid was subjected to fractional distillation to obtain 37.9 g of perfluoro(3-fluorosulfonyl)propionic acid fluoride. The yield was 55%.

EXAMPLE 6

The electrolytic cell as described in Example 1 was charge with 500 ml of anhydrous hydrofluoric acid and 10 g of sodium fluoride, and preliminary electrolysis was conducted to remove minute amounts of impurities. Then, a solution of 36.6 g (0.3 mol) of 1,3-propanesultone in an equiamount by weight of anhydrous hydrofluoric acid was added into the electrolytic cell. The electrolysis was carried out at an anode current density of 2.08 A/dm$^2$, an electrolyte temperature of 9° to 10° C. and an electrolytic voltage of 6.2 V. The current quantity was 110 A-hr. The recovery of the intended compound from the gas mixture formed by the electrolysis was conducted in the same manner as described in Example 1. The yield of perfluoro(3-fluorosulfonyl)propionic acid fluoride was 43%.

EXAMPLE 7

In an electrolytic cell made of SUS 316L, ten anodes and eleven cathodes, each being formed of a nickel plate, were alternately arranged so that the effective current-flowing area was 16 dm$^2$ and the distance between every two adjacent electrodes was 2.0 mm. A feed tank was disposed, and the electrolysis was carried out while circulating the electrolyte by means of a circulating pump.

First, 2.5 liters of an anhydrous hydrofluoric acid solution containing 1,3-propanesultone at a concentration of 50% by weight was charged in the feed tank, and the solution was circulated at a flow rate of 1.0 liter/min and the electrolysis was carried out at a current density of 1.0 A/dm$^2$ and a temperature of 10° to 13° C. When the current quantity was 20% of the theoretical electricity quantity for the charged sultone (791 A-hr), the electrolysis was stopped. At this point, the anhydrous hydrofluoric acid solution contained the starting sultone at a concentration of 23.6% by weight and partially fluorinated intermediates at a concentration of 31.0% by weight, while 104.8 g of the intended perfluoro(3-fluorosulfonyl)propionic acid fluoride was collected in a cooling trap. The current efficiency with respect to the total of the intermediate and the formed acid fluoride was 80%.

Then, the electrolysis was further conducted by using the thereby obtained electrolyte. In order to maintain the starting compound concentration at 23.6% as precisely as possible, the starting compound was continuously added according to the consumption rate of the starting compound. The electrolysis was conducted for 500 hours in a continuous manner, and the amount of the starting compound added during this period was 3050 g as a whole. The anhydrous hydrofluoric acid solution left after termination of the electrolysis contained the starting compound at a concentration of 24.6% by weight and the intermediate at a concentration of 32.5% by weight. The obtained amount of the intended compound was 4657 g. From these data, it was confirmed that the yield was 81.6 mol % based on the starting sultone added and the current efficiency was 80.5%.

EXAMPLE 8

In the electrolytic cell as described in Example 1 was charged 450 ml of anhydrous hydrofluoric acid, and preliminary electrolysis was conducted to remove minute amounts of impurities. A solution of 24.4 g (0.2 mol) of 1,3-propanesultone and 28.0 g (0.2 mol) of 3-hydroxy-1-propanesulfonic acid in an equiamount by weight of anhydrous hydrofluoric acid was then added into the electrolytic cell. The electrolysis was carried out at an anode current density of 0.05 A/dm$^2$, an electrolyte temperature of 15° to 16° C. and an electrolytic voltage of 5.2 V while flowing helium gas at a rate of 50 c.c./min through a cock disposed on the lower end of the electrolytic cell. The current quantity was 225.1 A-hr.

The gas mixture formed by the electrolysis was passed through a sodium fluoride pipe to remove entrained hydrogen fluoride and was then collected in a trap colled to −78° C. by dry ice-acetone. The collected liquid was subjected to fractional distillation to obtain 32.7 g of perfluoro(3-fluorosulfonyl)propionic acid fluoride. The yield was 48%.

REFERENCE EXAMPLE

The electrolytic cell as described in Example 1 was charged with 500 ml of anhydrous hydrofluoric acid and preliminary electrolysis was conducted to remove minute amounts of impurities. 46 g of perfluoro(3-fluorosulfonyl)propionic acid fluoride was then charged in the electrolytic cell, and the electrolysis was carried out at an anode current density of 1.04 A/dm$^2$ and an electrolyte temperature of 13° C. The initial electrolytic voltage of 5.7 V was finally increased to 7.7 V. The current quantity was 30 A-hr.

The gas mixture formed by the electrolysis was passed through a sodium fluoride pipe to remove entrained hydrogen fluoride and was then collected in a trap cooled to −78° C. by dry ice-acetone. The collected liquid was subjected to fractional distillation to recover 9.5 g of the starting perfluoro(3-fluorosulfonyl)propinic acid fluoride and obtain 27.7 g of perfluoroethanesulfonyl fluoride. The starting compound recovery ratio was 20.7% and the ratio of decomposition of the starting acid fluoride to perfluoroethanesulfonyl fluoride was 68.6%.

What is claimed is:

1. A process for the preparation of an (ω-fluorosulfonyl)haloaliphatic carboxylic acid fluoride which comprises subjecting to electrolysis an electrolyte comprising a compound represented by the formula:

$$OCH_2(CX_1X'_1CX_2X'_2 \ldots CX_nX'_n)SO_2 \quad (1)$$

wherein n is an integer of from 1 to 4, $X_1$ through $X_n$ and $X'_1$ through $X'_n$ each independently stand for H, Cl or F, and liquid hydrogen fluoride in an electrolytic cell to effect electrolytic fluorination of said compound, thereby to obtain an (ω-fluorosulfonyl)haloaliphatic carboxylic acid fluoride represented by the formula:

$$FSO_2(CZ_1Z'_1CZ_2Z'_2 \ldots CZ_nZ'_n)COF$$

wherein $Z_1$ through $Z_n$ and $Z'_1$ through $Z'_n$ each independently stand for F or Cl, and n is as defined above.

2. A process according to claim 1, wherein $X_1$ through $X_n$ and $X'_1$ through $X'_n$ each independently stand for H.

3. A process according to any of claims 1 or 2, wherein the electrolysis is effected at an electricity quantity of 1 to 200% based on the theoretical electricity quantity.

4. A process according to claim 1, wherein the electrolysis is conducted while keeping the electrolyte to have a composition obtained at the time of current-flowing at an electricity quantity of 10 to 50% based on the theoretical electricity quantity.

5. A process according to claim 1, wherein the electrolysis is conducted while successively withdrawing from the electrolytic cell the (ω-fluorosulfonyl)haloaliphatic carboxylic acid fluoride formed.

6. A process according to claim 1, wherein the electrolysis is conducted at an electrolytic temperature of −10° to 50° C. and a current density of 0.1 to 5 A/dm$^2$.

* * * * *